United States Patent [19]

Hoffman

[11] Patent Number: 4,662,761

[45] Date of Patent: May 5, 1987

[54] SEQUENTIAL DRAWER SLIDE

[75] Inventor: Keith A. Hoffman, Hudsonville, Mich.

[73] Assignee: Knape & Vogt Manufacturing Company, Grand Rapids, Mich.

[21] Appl. No.: 897,777

[22] Filed: Aug. 18, 1986

[51] Int. Cl.[4] ..... F16C 29/04; A47B 88/00; A47B 88/10

[52] U.S. Cl. ..... 384/18; 312/334; 312/339; 384/49

[58] Field of Search ..... 384/18, 19, 49; 312/334, 335, 339

[56] References Cited

U.S. PATENT DOCUMENTS

| | | | |
|---|---|---|---|
| 1,537,067 | 5/1925 | Card . | |
| 2,125,619 | 8/1938 | Parent . | |
| 2,430,141 | 11/1947 | Reeves . | |
| 2,606,090 | 8/1952 | Straubel | 312/339 |
| 2,687,924 | 8/1954 | Gomersall . | |
| 2,728,626 | 12/1955 | Gussack | 312/333 |
| 2,739,027 | 3/1956 | Gussack | 312/333 |
| 2,805,106 | 9/1957 | Penkala . | |
| 2,859,070 | 11/1958 | Gomersall . | |
| 2,869,961 | 1/1959 | Gomersall | 312/339 |
| 3,050,348 | 8/1962 | Pipe . | |
| 3,078,129 | 2/1963 | Beeck . | |
| 3,131,982 | 5/1964 | Bullock | 312/339 |
| 3,203,749 | 8/1965 | Bullock et al. | 312/339 |
| 3,297,386 | 1/1967 | Stanek et al. | 312/270 |
| 3,371,968 | 3/1968 | Loake . | |
| 3,431,042 | 3/1969 | Pipe | 312/339 |
| 3,449,033 | 6/1969 | Pipe | 312/339 |
| 3,488,097 | 1/1970 | Fall . | |
| 3,521,939 | 7/1970 | Fall et al. | 312/348 |
| 3,545,833 | 12/1970 | Stein et al. | 312/341 |
| 3,588,198 | 6/1971 | Stewart et al. . | |
| 3,687,505 | 8/1972 | Fall et al. . | |
| 3,722,964 | 3/1973 | Chitester et al. . | |
| 3,778,120 | 12/1973 | Hagen et al. . | |
| 3,857,618 | 12/1974 | Hagen et al. . | |
| 3,901,564 | 8/1975 | Armstrong . | |
| 3,901,565 | 8/1975 | Hagen et al. . | |
| 3,904,254 | 9/1975 | Hagen et al. . | |
| 3,911,835 | 10/1975 | Schill | 108/87 |
| 3,912,341 | 10/1975 | Stein . | |
| 3,975,063 | 8/1976 | Mahotka et al. . | |
| 4,025,138 | 5/1977 | Kittle . | |
| 4,067,632 | 1/1978 | Sekerich | 312/341 R |
| 4,183,596 | 1/1980 | Greene et al. | 312/333 |
| 4,272,139 | 6/1981 | Fler | 312/334 |
| 4,370,007 | 1/1983 | Fler | 312/334 |
| 4,469,384 | 9/1984 | Fler et al. | 384/18 X |
| 4,537,450 | 8/1985 | Baxter | 384/18 |
| 4,549,773 | 10/1985 | Papp et al. | 384/18 |
| 4,560,212 | 12/1985 | Papp et al. | 384/18 |

FOREIGN PATENT DOCUMENTS

| | | |
|---|---|---|
| 2721231 | 11/1978 | Fed. Rep. of Germany . |
| 342716 | 1/1960 | Switzerland . |
| 2028109 | 3/1980 | United Kingdom . |

*Primary Examiner*—Stuart S. Levy
*Assistant Examiner*—Thomas R. Hannon
*Attorney, Agent, or Firm*—Price, Heneveld, Cooper, DeWitt & Litton

[57] ABSTRACT

A sequencing mechanism for a sequential drawer slide includes a resiliently compressible sequence control roller carried by the intermediate slide member and mutually opposing bosses on the drawer and cabinet slide members. The bosses are in the travel path of the control roller to selectively engage the control roller and compress it therebetween at the transition point to thereby smoothly sequence movement of the slide members.

22 Claims, 12 Drawing Figures

SEQUENTIAL DRAWER SLIDE

BACKGROUND OF THE INVENTION

The present invention relates to a multi-part drawer slide, and more particularly to a sequential drawer slide wherein movement of the slide parts is sequenced during opening and closing of the drawer.

A wide variety of multi-part drawer slides has been developed to support a drawer within a cabinet. Multi-part slides permit the supported drawer to be fully withdrawn from the cabinet and are therefore often used for office filing cabinet drawers and other applications where full access to the drawer is important.

Typically, multi-part slides include a drawer slide member to be secured to a drawer, a cabinet slide member to be secured to a cabinet, and an intermediate slide member slidingly interfitted with both of the drawer and cabinet slide members. Proper coordination of the movement of the slide members is important to prevent binding and/or racking of the slide, which creates highly detrimental dynamic stress loading in the slide members. Random or uncoordinated movement of the various slide members results in 1) lateral swaying of the drawer, (2) undesirably high opening and closing forces, and (3) increased wear and decreased service life because of the dynamic stress loading.

In efforts to overcome the problems associated with random slide movement, coordinating mechanisms for multi-part slides have been developed. Such mechanisms fall into one of two broad categories--progressive slides and sequential slides. Both types of mechanisms are typically incorporated into "precision drawer slides" which have exact tolerances between the various slide components.

In progressive slides, the intermediate slide moves at exactly one-half the rate or distance of the drawer slide during all opening and closing movement. Stated another way, the intermediate slide always moves an equal distance relative both the drawer and cabinet slides. These slides most typically include rollers, cables, or racks-and-pinions as the coordinating mechanism. Rollers are most frequently used; and illustrative constructions are shown in U.S. Pat. No. 4,067,632, issued Jan. 10, 1978, to Sekerich, entitled DRAWER SLIDE; 3,901,565, issued Aug. 26, 1975, to Hagen et al, entitled ADAPTOR AND LATCHING MEANS FOR REMOVABLY ATTACHING DRAWERS TO TELESCOPING BALL BEARING DRAWER SLIDES; and 3,901,564, issued Aug. 26, 1975, to Armstrong entitled DRAWER EXTENSIBLE SLIDE CHASSIS. However, all progressive slides have a relatively short useful life because of the relatively high and constant dynamic stresses borne primarily by the cabinet slide member as the intermediate slide member always moves relative thereto. Further, all progressive coordinating mechanisms create a constant resistive opening and closing force or drag. Those mechanisms utilizing a control roller also wear rapidly with subsequent failure. All of these problems are exacerbated when the drawers are wide and/or heavily loaded--for example in one of the most common uses in lateral file cabinets.

Sequential drawer slides were developed in part to enhance the life of the drawer slide by reducing the dynamic stress loading on all of the slide members, particularly the cabinet member. In sequential slides, only two slide members are permitted to move relative one another at any given time. Movement of the drawer slide member with respect to the intermediate slide member occurs only when the intermediate slide member is locked with respect to the cabinet slide member and vice versa. Most desirably, the sequencing mechanism (1) interlocks the drawer and intermediate slide members during their extension as the drawer is initially withdrawn from the cabinet, and then (2) releases the drawer and intermediate slide members and interlocks the fully extended intermediate slide member and the cabinet slide member as the drawer slide member is extended as opening is continued. The sequencing mechanism insures full extension of the intermediate slide member before any extension of the drawer slide member to reduce the dynamic stress loading on the cabinet slide member and enhance the life of the slide. However, known sequencing mechanisms often "catch" or require a large opening or closing force at the transition point between movement of the intermediate slide member and the drawer slide member. Further, known sequencing mechanisms are relatively complex, resulting in high manufacturing cost and less than desirable reliability.

SUMMARY OF THE INVENTION

The aforementioned problems are overcome in the present invention wherein a sequential drawer slide includes an extremely simple yet positive sequencing mechanism with little "catch" at the transition point. More particularly, the sequencing mechanism includes a boss on each of the drawer and cabinet slide members and a resiliently compressible sequence controller carried by the intermediate slide member and engageable by the bosses during movement of the slide members. The drawer slide boss is positioned to engage the sequence controller and prevent relative movement between the drawer and intermediate slide members during relative movement of the intermediate and cabinet slide members. The channel slide boss is positioned to engage the sequence controller to prevent relative movement of the intermediate and cabinet slide members during relative movement of the drawer and intermediate slide members. At the transition point, both bosses engage, compress, and pass to an opposite side of the sequence controller to either lock or unlock their respective slides and thereby provide sequenced movement.

In a preferred embodiment of the invention, the sequence controller is a rotatable control roller, which further reduces resistance at the transition point.

The defined construction provides extremely reliable sequencing movement for the slide. Tests conducted to date indicate that the present slide has a useful life of 4 to 8 times more cycles than progressive slides currently commercially available. The cost of manufacture is low, and the ease of manufacture is high.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
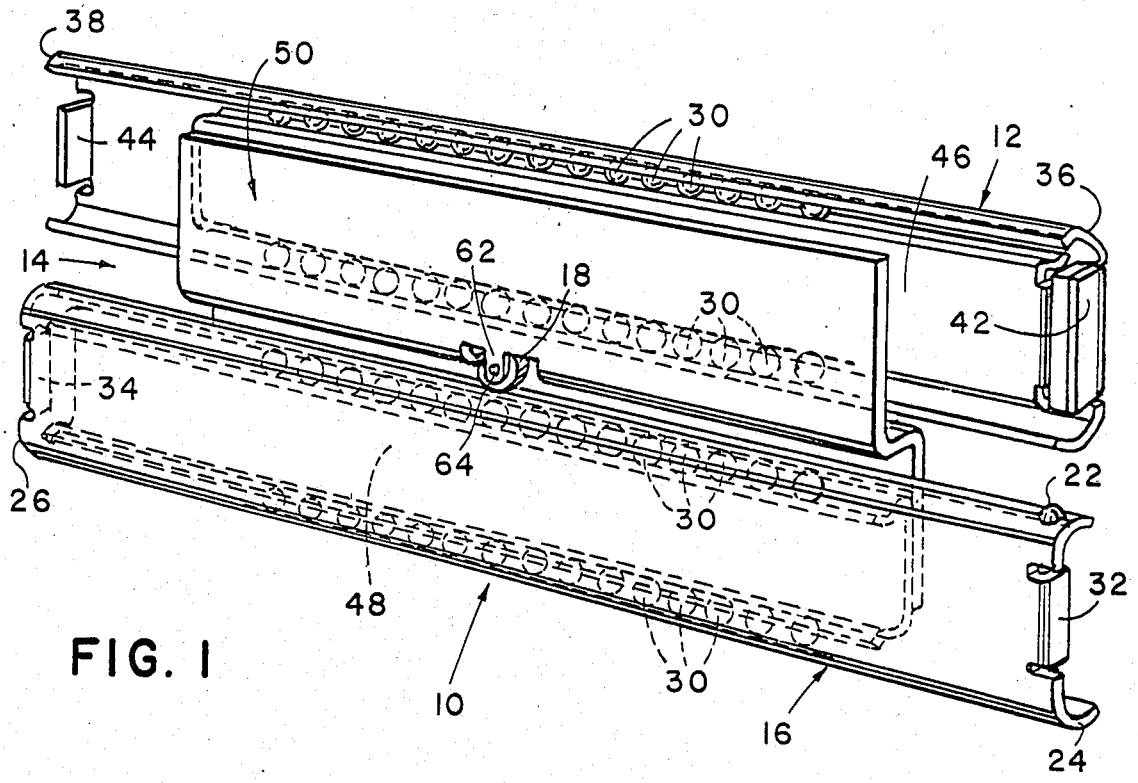
FIG. 1 is perspective view of the sequential slide of the present invention.
Figure 3:
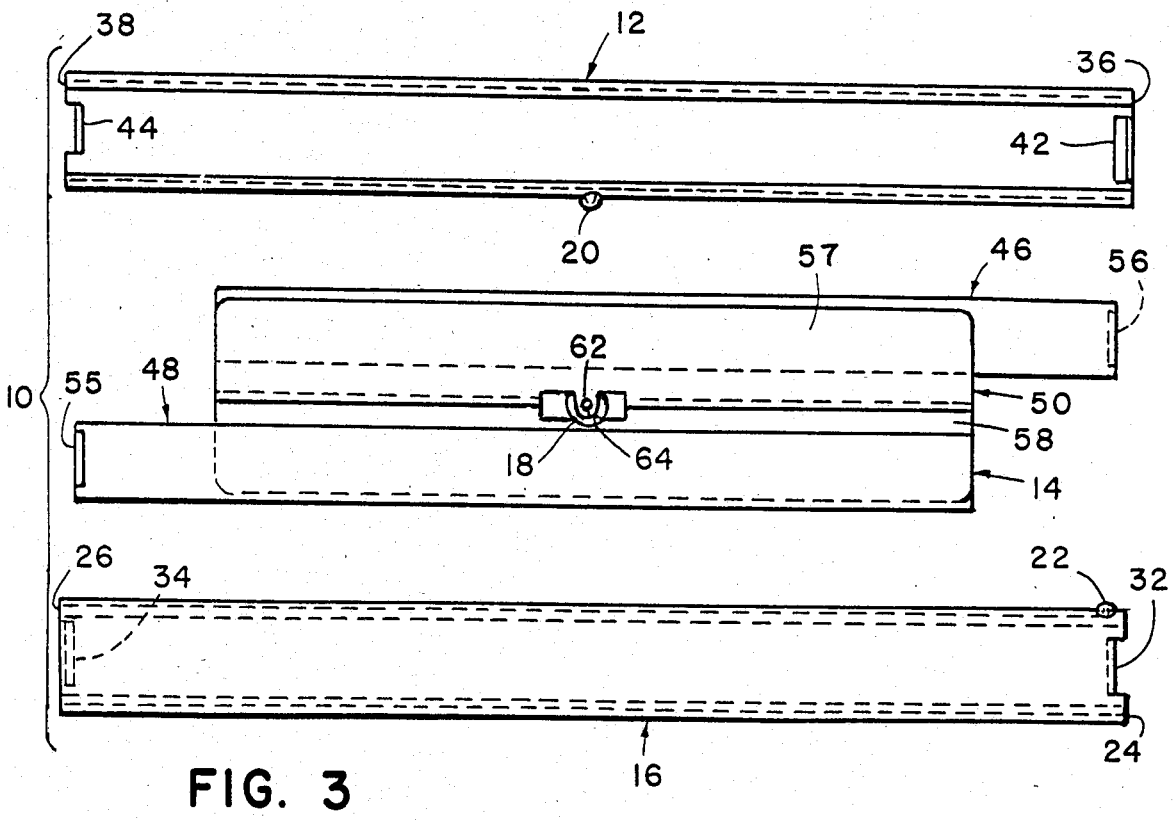
FIG. 3 is a plan exploded view of the slide.
Figure 2:
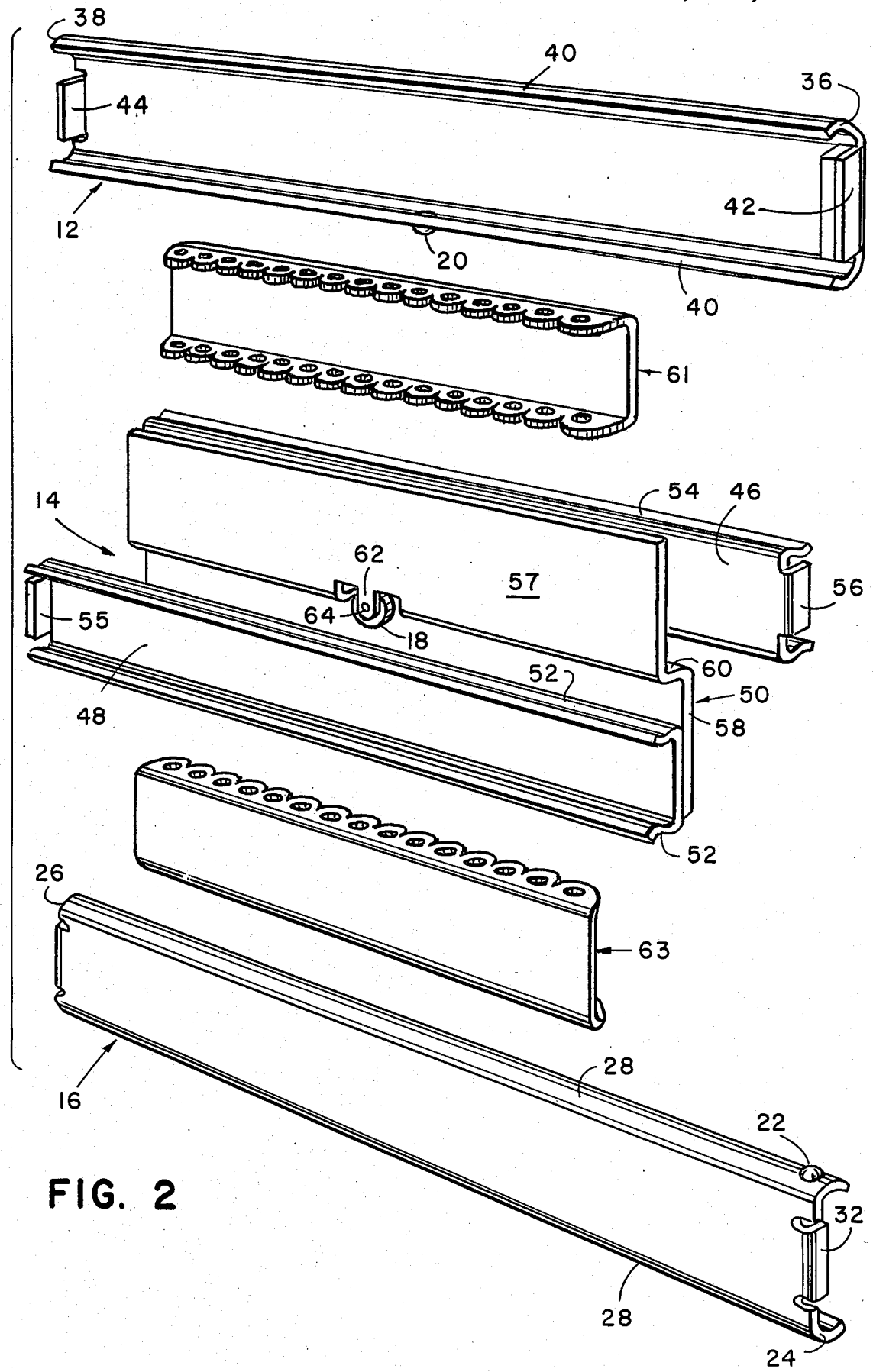
FIG. 2 is a perspective exploded view of the slide.

A sequential drawer slide constructed in accordance with a preferred embodiment of the invention is illustrated in the drawings and generally designated 10. The slide includes a drawer slide member 12, an intermediate slide member 14, and a cabinet slide member 16. Both the drawer and cabinet slide members 12 and 16 are slidably interfitted with the intermediate slide member 14 enabling the slide members to travel in a linear path with respect to one another. The slide 10 further includes a sequencing mechanism including a sequence control roller 18, a drawer boss 20, and a cabinet boss 22. The control roller 18 is carried by the intermediate slide member 14; While the drawer and cabinet bosses 20 and 22 extend from the drawer and cabinet slide members 12 and 16, respectively. As illustrated in detail in FIGS. 5–12, the bosses and control roller cooperate to sequence movement of the slide members to insure that, during opening, the drawer and intermediate slide members are first withdrawn as a unit from the cabinet slide member, and then are interlocked during continued movement of the drawer slide member.

With the exception of the sequencing mechanism, the slide 10 is of a type generally well known to those having ordinary skill in the art. Examples of similar constructions are illustrated in U.S. Pat. No. 4,067,632 to Sekerich, entitled DRAWER SLIDE; 3,901,565 to Hagen et al, entitled ADAPTER AND LATCHING MEANS FOR REMOVABLY ATTACHING DRAWERS TO TELESCOPING BALL BEARING DRAWER SLIDES; and 3,778,120 to Hagen et al entitled PRECISION TELESCOPING BALL BEARING DRAWER SLIDE SUSPENSION FOR WOOD AND METAL FURNITURE PRODUCTION.

The cabinet slide member 16 is generally C-shaped in cross section and includes a forward end 24 and a rear end 26. The curved portions 28 of the C-shape define races in which balls 30 ride. Stops or tabs 32 and 34 are integrally formed with the cabinet slide member and extend from the forward and rear ends 24 and 26, respectively. The stops cooperate with the intermediate slide member as will be described, to limit the movement of the intermediate slide member 14 with respect to the cabinet slide member 16 between fully extended and fully retracted positions.

The drawer slide member 12 is generally identical to the cabinet channel member 16 with the exception that the drawer member is oriented directly opposite to the cabinet member. The drawer slide member 12 is generally C-shaped in cross section and includes a forward end 36 and a rear end 38. The curved portions 40 of the C-shape define races in which balls 30 ride to slidingly interfit the drawer and intermediate slide members. Integral stops or tabs 42 and 44 extend from the forward and rear ends 36 and 38, respectively. The stops 42 and 44 cooperate with the intermediate slide member 14 as will be described the limit movement of the drawer slide member with respect to the intermediate slide member between fully extended and fully retracted positions.

The intermediate slide member 14 includes three pieces welded, riveted, or otherwise fixedly secured together. The three pieces include a drawer rail 46, a cabinet rail 48, and an interconnecting bracket 50. The drawer and cabinet rails 46 and 48 are generally identical to one another and each is generally C-shaped in cross section. The cabinet rail 48 includes reverse curves 52 at the upper and lower extent of the C-shape cross section to define races in which balls 30 ride. Similarly, the drawer rail 46 includes reverse curves 54 at its upper and lower extent to define races in which balls 30 ride. An integral stop 55 extends from the rear end of the cabinet rail 48; while an integral tab or stop 56 extends from the forward end of the drawer rail 46.

The intermediate bracket 50 is Z-shaped in cross section and includes a drawer-rail-supporting flange 57, a cabinet-rail-supporting flange 58, and an interconnecting flange 60. The flanges 57 and 58 are generally parallel to one another and offset by the width of the flange 60. The drawer and cabinet rails 46 and 48 overlie and are welded to the supporting flanges 57 and 58, respectively. Other suitable attachment means can be utilized to rigidly intersecure these pieces.

Figure 4:
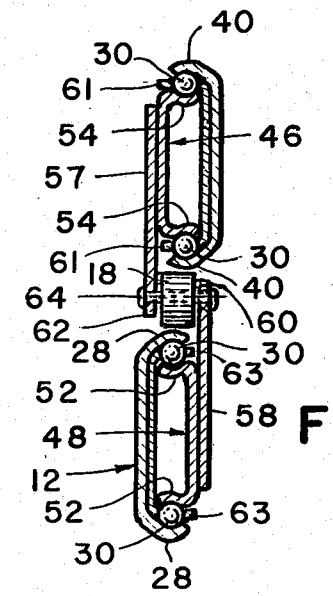
FIG. 4 is an end elevational view of the slide.

A plurality of balls 30 (FIGS. 1 and 4) ride in the raceways defined by the drawer and cabinet slide members 12 and 16 and the drawer and cabinet rail stops 55 and 56. The balls 30 are retained in position by upper and lower retainers 61 and 63 as is customary in the art.

Linear movement of the slide members 16, 14, and 12 is limited via the engagement of the stops 32, 34, 42, and 44 with the drawer and cabinet rail stops 55 and 56 and the ball retainers 61 and 63 as is conventional in the art. In the fully closed or retracted position (FIGS. 1 and 5), the stop 55 on the cabinet rail 48 engages the stop 34 on the cabinet slide member 16, and the stop 56 or the drawer rail 46 engages the stop 42 on the drawer slide member 12. In the open or fully extended position (FIG. 11), the lower ball retainer 63 within the cabinet slide member engages the stop 32 on the cabinet slide member 16 and the stop 55 on the cabinet rail 48; and the upper ball retainer 61 within the drawer slide member 12 engages the stop 44 on the drawer slide member 12 and the stop 56 on the drawer rail 46. Consequently, the intermediate slide member 14 is movable with respect to the cabinet slide member 16 between fully extended and fully retracted positions; and the drawer slide member 12 is movable relative intermediate slide member 14 between fully extended and fully retracted positions.

An arm 62 extends downwardly from and is parallel to the drawer rail flange 57. A pin 64 extends between the arm 62 and an opposite arm (not shown) on the channel rail web 58 to rotatably support the sequence control roller 18 approximately midway along the length of the intermediate slide member. The diameter of the control roller 18 is purposely and necessarily smaller than the vertical distance between the channel and drawer slide members 16 and 12 so that the control roller does not engage or rotate against these slide members during movement of the slide. It can only engage the bosses. The sequence control roller 18 can be mounted in the same location as the control roller in a progressive slide, so that the present sequential slide can be fabricated of slide members designed for progressive slides. Preferably, the control roller 18 or other equivalent control means, is resiliently compressible, and most preferably is a plastic or polymer to be deformable by cooperative, mutually opposing action of the basses, with a return memory to return to its original configuration.

Bosses 20 and 22 are formed in the drawer and cabinet slide members 12 and 16, respectively. Bosses 20 and 22 are preferably formed by stamping or otherwise deforming the drawer and channel slide members 12 and 16, respectively. The position of the bosses with respect to the control roller 18 is extremely important to the proper sequential operation of the slide members as described below. The drawer boss 20 is approximately midway along the length of the drawer slide member 12, and the cabinet boss is immediately adjacent the forward end 24 of the cabinet channel.

Operation

FIGS. 5–12 illustrate the sequential operation of the multi-part slide as sequenced by the sequence control roller 18 and the bosses 20 and 22.

Figure 5:
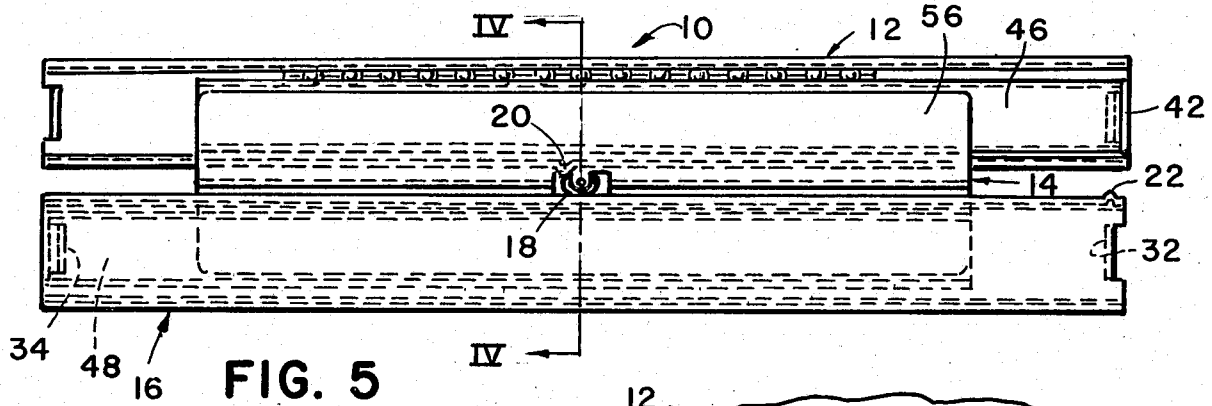
FIG. 5 is a plan view of the slide in the closed position.
Figure 6:
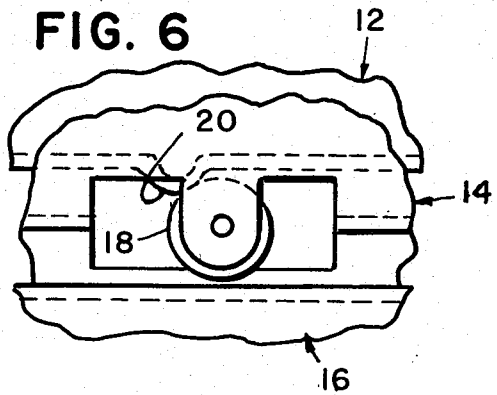
FIG. 6 is a fragmentary enlarged plan view of the catch area in FIG. 5.

FIGS. 5 and 6 illustrate the slide 10 in the fully closed position. The cabinet rail 48 abuts the stop 34; and the drawer rail 46 abuts the stop 42. As illustrated in greater detail in FIG. 6, the boss 20 engages and is immediately adjacent the control roller 18 and is positioned rearwardly thereof. The drawer slide member 12 is therefore locked or fixed with respect to the intermediate slide member 14. Movement of the drawer slide member 12 in the forward direction is prevented by the boss 20 engaging the control roller 18; and relative movement in the rearward direction is prohibited by the stop 42 engaging the drawer rail 46.

Figure 8:
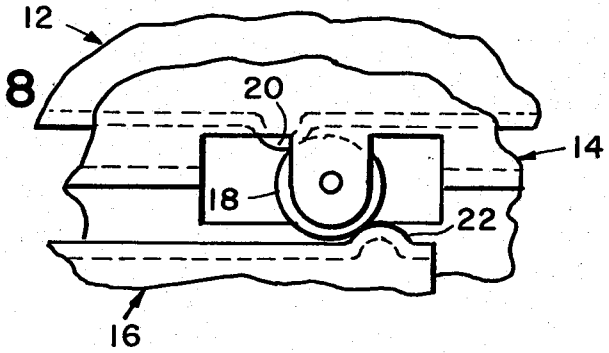
FIG. 8 is a fragmentary enlarged plan view of the catch area in FIG. 7.
Figure 7:
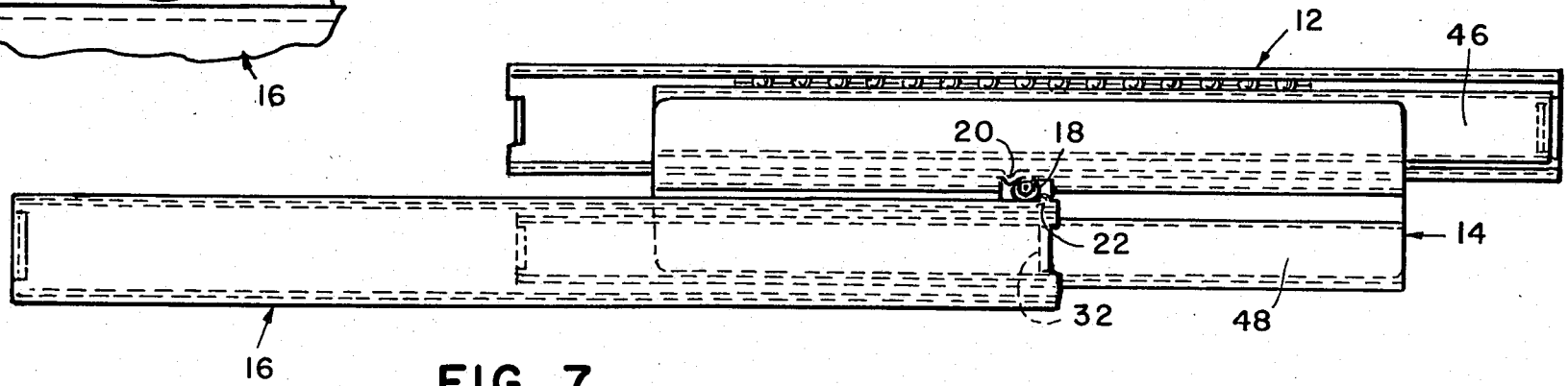
FIG. 7 is a plan view of the slide in the almost-half-open position.

Initial withdrawal of a drawer supported on the slide 10 causes the interlocked drawer and intermediate slide members 12 and 14 to move as a unit with respect to the channel slide member 16 until the position illustrated in FIGS. 7–8 is reached. At this point, the drawer boss 20 still engages the control roller 18 rearwardly thereof; and the control roller 18 now engages the cabinet boss 22 which is forward of the control roller.

Further withdrawal of the drawer from this position causes a transition wherein both of the bosses 20 and 22 travel to opposite sides of the control roller 18. In moving the drawer the slight distance from the position illustrated in FIGS. 7 and 8 to the position illustrated in FIGS. 9 and 10, the drawer boss 20 moves from immediately rearward of to immediately forward of the control roller 18; and the cabinet boss 22 moves from immediately forward of to immediately rearward of the control roller 18. Both bosses 20 and 22 slightly compress the control roller 18 simultaneously in opposing manner during the transition; and the control roller 18 is slightly rotated thereby through a portion of a turn to facilitate smooth passages of the bosses.

Figure 9:
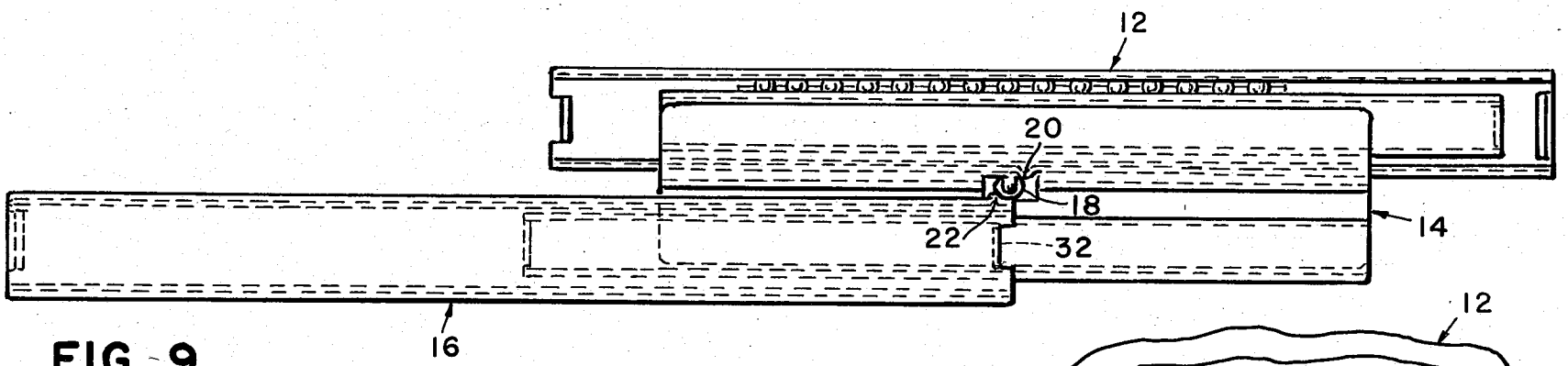
FIG. 9 is a plan view of the slide in the just-over-half-open position.
Figure 10:
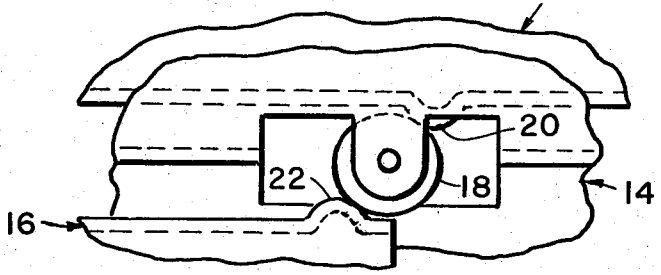
FIG. 10 is a fragmentary enlarged plan view of the catch area in FIG. 9.

When this transition during opening is complete, the slide members 16, 14, and 12 are in the position illustrated in FIGS. 9 and 10. The channel ball retainer 63 abuts the stops 32 and 55 to prevent further forward movement of the intermediate slide member 14 with respect to the cabinet slide member 16. The engagement of the boss 22 with the control roller 18 prevents rearward movement of the intermediate slide member 14 with respect to the cabinet slide member 16. Consequently, the intermediate and cabinet slide members are now interlocked. As the drawer continues to be withdrawn or extended from the cabinet, the drawer slide member 12 moves relative the intermediate slide member 14 to the fully extended position.

Figure 11:
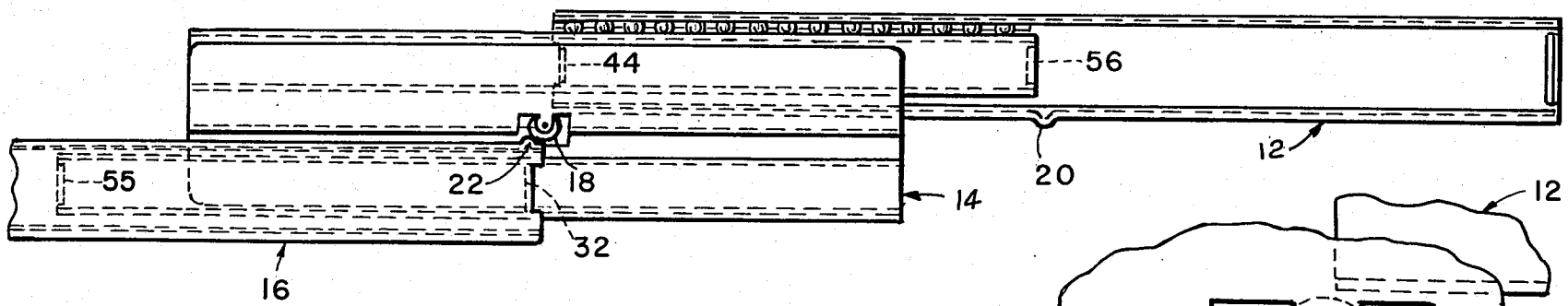
FIG. 11 is a fragmentary plan view of the slide in the fully open position.
Figure 12:
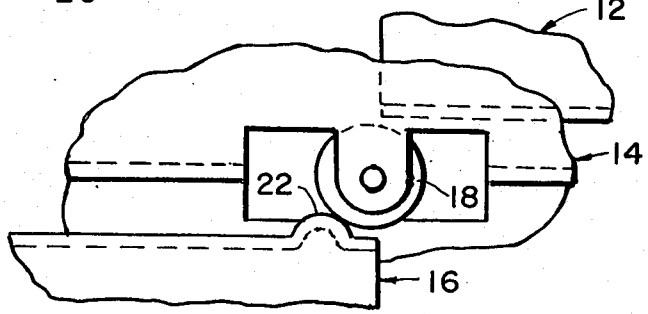
FIG. 12 is a fragmentary enlarged plan view of the catch area in FIG. 11.

The fully open position of the slide 10 is illustrated in FIGS. 11 and 12. The cabinet boss 22 still engages the control roller 18 immediately rearwardly thereof; and the cabinet ball retainer still engages the stops 32 and 55 to interlock the intermediate and cabinet members 14 and 16. Additionally, the drawer ball retainer 61 engages the stops 44 and 56 to limit further forward movement of the drawer slide member 12 with respect to the intermediate slide member 14.

The closing sequence of the slide is exactly opposite that described for the opening sequence with the slide passing from the position illustrated in FIGS. 11 and 12 to the position illustrated in FIGS. 9 and 10 to the position illustrated in FIGS. 7 and 8 and finally to the position illustrated in FIGS. 5 and 6.

The simple sequencing mechanism, comprising the control roller 18 and the bosses 20 and 22, insures that (1) during opening, the intermediate slide member 14 is fully extended before the drawer slide member 12 begins its movement and (2) during closing insures that the drawer slide member 12 is fully retracted before the intermediate slide member 14 begins its movement. This sequenced motion of the drawer slide greatly enhances the slide life and/or enables lighter weight components to be utilized in its manufacture. The sequencing mechanism requires an almost unnoticeable and smooth momentary change in force to move the drawer past the transition point. Both the compressibility and the rotatability of the control roller 18 enhance the relatively easy movement of the bosses 20 and 22 therealong.

The above description is that of a preferred embodiment of the invention. Various alterations and changes can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A sequential drawer slide comprising:

a cabinet slide member;

an intermediate slide member;

a drawer slide member;

first anti-friction means for slidingly coupling said cabinet and intermediate slide members for linear movement;

first stop means for limiting the movement of said intermediate slide member with respect to said cabinet slide member between extended and retracted positions;

second anti-friction means for slidingly coupling said drawer and intermediate slide members for linear movement;

second stop means for limiting the movement of said drawer slide member with respect to said intermediate slide member between extended and retracted positions;

a resiliently compressible sequence control roller rotatably supported by said intermediate slide member, clearance being provided between said control roller and said cabinet and drawer slide members so that said control roller normally does not rotate thereagainst;

a cabinet boss extending from said cabinet slide member to engage said control roller during relative movement of said cabinet and intermediate slide members, said cabinet boss being forward of said control roller during substantially all relative movement of said cabinet and intermediate slide members, said cabinet boss being immediately adjacent and rearward of said control roller when said intermediate slide member is in its extended position, said boss compressing said control roller when moving past said control roller;

a drawer boss extending from said drawer slide member to engage said control roller during relative movement of said drawer and intermediate slide members, said drawer boss being immediately adjacent and rearward of said control roller when said drawer slide member is in its retracted position, said boss being forward of said control roller during substantially all relative movement of said drawer and intermediate slide members, said drawer boss compressing said control roller when moving past said control roller.

2. A sequential drawer slide as defined in claim 1 wherein one of said cabinet and drawer slide members is directly above the other of said slide members, and further wherein said control roller is between said channel and drawer slide members.

3. A sequential drawer slide as defined in claim 2 wherein said control roller is located approximately midway along the length of said intermediate slide member.

4. A sequential drawer slide as defined in claim 3 wherein said cabinet boss is adjacent the forward end of said cabinet slide member.

5. An improved sequential drawer slide comprising:

a cabinet slide member;

an intermediate slide member;

a drawer slide member;

antifriction means for movably interconnecting said cabinet and intermediate slide members and for movably interconnecting said drawer and intermediate slide members;

stop means for limiting the relative movement of said intermediate and cabinet slide members and for limiting the relative movement of said drawer and intermediate slide members; and sequencing means for sequencing the movement of said slide members;

wherein the improvement comprises said sequencing means comprising:

an intermediate sequence control member carried by said intermediate slide member and normally engaging neither of said cabinet and drawer slide members;

a cabinet engagement member carried by said cabinet slide member for engagement with said control member during relative movement of said cabinet and intermediate slide members, said cabinet engagement member being on a first side of said control member during substantially all relative movement of said cabinet and intermediate members, said cabinet engagement member engaging said control member on a second side of said control member when said intermediate slide member is fully extended from said cabinet slide member; and a drawer engagement member carried by said drawer slide member for engagement with said control member during relative movement of said drawer and intermediate slide members, said drawer engagement member engaging said control member on the first side of said control member when said drawer slide member is fully retracted with respect to said intermediate slide member, said drawer engagement member being on the second side of said control member during substantially all relative movement of said drawer and intermediate slide members.

6. A sequential drawer slide as defined in claim 5 wherein said control member is rotatably supported by said intermediate slide member to facilitate movement of said cabinet and drawer engagement members past said control member.

7. A sequential drawer slide as defined in claim 6 wherein said control member is a circular control roller mounted for rotation about its center.

8. A sequential drawer slide as defined in claim 5 wherein said control member is resiliently compressible to facilitate movement of said cabinet and drawer engagement members past said control member.

9. A sequential drawer slide as defined in claim 5 wherein one of said channel and drawer slide members is mounted above the other slide member, and further wherein said control member is located directly therebetween.

10. A sequential drawer slide as defined in claim 5 wherein said control member is approximately midway long the length of said intermediate slide.

11. A sequential drawer slide as defined in claim 10 wherein said cabinet engagement member is adjacent the forward end of said cabinet slide member.

12. A sequential drawer slide comprising:

cabinet, intermediate, and drawer slide members each having a forward end and a rearward end, said intermediate slide member being movable with respect to said cabinet slide member between extended and retracted positions, said drawer slide member being movable with respect to said intermediate slide member between extended and retracted positions;

sequencing means for permitting said intermediate slide member to move relative said cabinet slide member only when said drawer slide member is in its retracted position and for permitting said drawer slide member to move relative said intermediate slide member only when said intermediate slide member is in its extended position, said sequencing means including a control element carried by said intermediate slide member and cabinet and drawer protrusions secured to said cabinet and drawer slide members, respectively, said control element being free of contact with said cabinet and drawer slide members, said cabinet and drawer protrusions being positioned with respect to said control element so that at least one of said cabinet and drawer protrusions engages said control element during all movement of said slide members to permit relative movement between said intermediate slide member and only one of said cabinet and drawer slide members at any one time, both of said cabinet and drawer protrusions engaging and passing said control element when said intermediate slide member is fully extended and said drawer slide member is fully retracted.

13. A sequential drawer slide as defined in claim 12 wherein one of said drawer and cabinet slide members is above the other slide member, and further wherein said control element is between said cabinet and drawer slide members.

14. A sequential drawer slide as defined in claim 13 wherein said control element comprises a resiliently compressible member.

15. A sequential drawer slide as defined in claim 14 wherein said control element is a rotatable control roller.

16. A sequential drawer slide as defined in claim 13 wherein said control element is approximately midway along the length of said intermediate slide member.

17. A sequential drawer slide as defined in claim 16 wherein said cabinet protrusion is adjacent the forward end of said cabinet slide member.

18. A sequential drawer slide assembly comprising:

a cabinet slide;

an intermediate slide interfitted with said cabinet slide to be movable between retracted and extended positions;

a drawer slide interfitted with said intermediate slide to be movable between retracted and extended positions; and a sequencing control including a resiliently deformable sequence controller on said intermediate slide and first and second controller deformers on said cabinet and drawer slides, respectively, said deformers being engageable with said controller during extension and retraction of said slides to momentarily deform said controller and sequence movement of said slides.

19. A sequential drawer slide assembly as defined in claim 18 wherein said sequcnce controller is midway along the length of said intermediate slide, and further wherein said deformers are on opposite sides of said controller.

20. A sequential drawer slide assembly as defined in claim 18 wherein said sequence controller is a control roller with a resiliently deformable periphery.

21. A sequential drawer slide assembly as defined in claim 20 wherein said deformers each comprise a protrusion.

22. A sequential drawer slide assembly as defined in claim 18 wherein clearance is provided between said sequence controller and each of said cabinet and drawer slides.

* * * * *